United States Patent [19]

Baker

[11] 4,137,591

[45] Feb. 6, 1979

[54] BOWLING ALLEY GUTTER DUSTER APPARATUS

[76] Inventor: David E. Baker, 1004 Gardenway, Apartment A, Manhattan, Kans. 66502

[21] Appl. No.: 828,454

[22] Filed: Aug. 29, 1977

[51] Int. Cl.[2] ..... A47L 11/24

[52] U.S. Cl. ..... 15/98; 118/108

[58] Field of Search ..... 15/49 R, 50 R, 98, 393, 15/395, 398, 51, 52; 51/174–176; 118/242, 108

[56] References Cited

U.S. PATENT DOCUMENTS 1,682,168 8/1928 Dorl ..... 15/98

*Primary Examiner*—Edward L. Roberts

*Attorney, Agent, or Firm*—Henderson, Sturm, Cepican & Fix

[57] ABSTRACT

A bowling alley gutter dusting apparatus is disclosed that automatically and simultaneously dusts four gutters and the ball return chute. The apparatus includes a dusting appendage, a housing unit, a guidance structure, and a propulsion system. A method for dusting bowling alley gutters is also disclosed.

10 Claims, 7 Drawing Figures

BOWLING ALLEY GUTTER DUSTER APPARATUS

BACKGROUND OF THE INVENTION

The sport of bowling is generally played on a bowling alley, otherwise known as a lane. At one end of the lane there are ten pins arranged to form a triangle, and at the other end the player or bowler stands. The object of the game is to roll a bowling ball down the lane and knock down the pins. Since the ball is not always correctly manipulated, the rolled ball will occasionally traverse the lane. In order to prevent the ball from interfering with adjacent lanes, a gutter is included on either side of the lane to direct the askew ball down to the pin end of the lane. Most bowling alleys also include an automatic ball return chute, whereby the rolled ball is returned to the bowler after his turn.

In the maintenance of bowling alleys, it becomes necessary to keep the above mentioned gutters and ball return chutes free from dust and dirt. Generally this is accomplished by having an individual proceed down each gutter and chute with a mop. The instant invention seeks to alleviate this time consuming chore as currently performed by using machinery and technology to circumvent the manual procedure.

SUMMARY OF THE INVENTION

It is, therefore, a primary object of this invention to provide an apparatus whereby bowling alley gutters and ball return chutes may be kept free of dust accumlation.

It is another object of this invention to provide an apparatus for the cleaning of bowling alley gutters that will clean a plurality of gutters simultaneously.

It is another object of this invention to provide an apparatus for the cleaning of bowling alley gutters that is self propelled.

It is yet another object of this invention to provide an apparatus for the cleaning of bowling alley gutters that will operate upon and be guided by a raised ball return chute.

It is a further object of this invention to provide an apparatus for the cleaning of bowling alley gutters that is inexpensive to manufacture, durable of construction, and highly effective in use.

BRIEF DESCRIPTION OF THE DRAWINGS

These and other objects will become more readily apparent when taken in view of the following disclosure, especially when taken in conjunction with the appended drawings, wherein.

DESCRIPTION OF THE PREFERRED EMBODIMENTS

Figure 1:
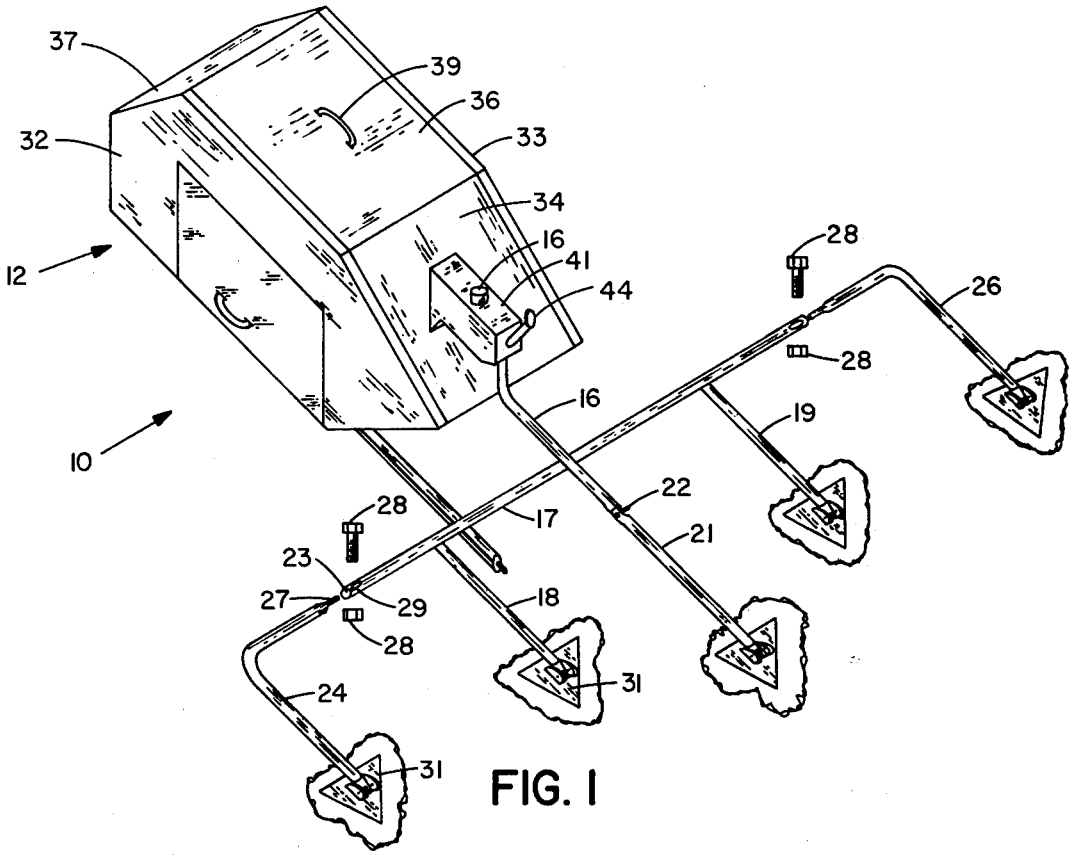
FIG. 1 is a perspective view of the apparatus.

Referring now to the drawings, and in particular to FIG. 1, the apparatus is generally depicted by the numeral 10. More particularly, the apparatus 10 includes a dusting appendage 11, a housing unit 12, a guidance structure 13 (FIG. 5) and a propulsion system 14.

With reference to FIG. 1, the dusting appendage 11 will be disclosed first. In the preferred embodiment, hollow metal piping is used as the structural medium for the dusting appendage, except where noted otherwise below. Other materials could clearly be substituted and similar or identical results obtained.

Figure 2:
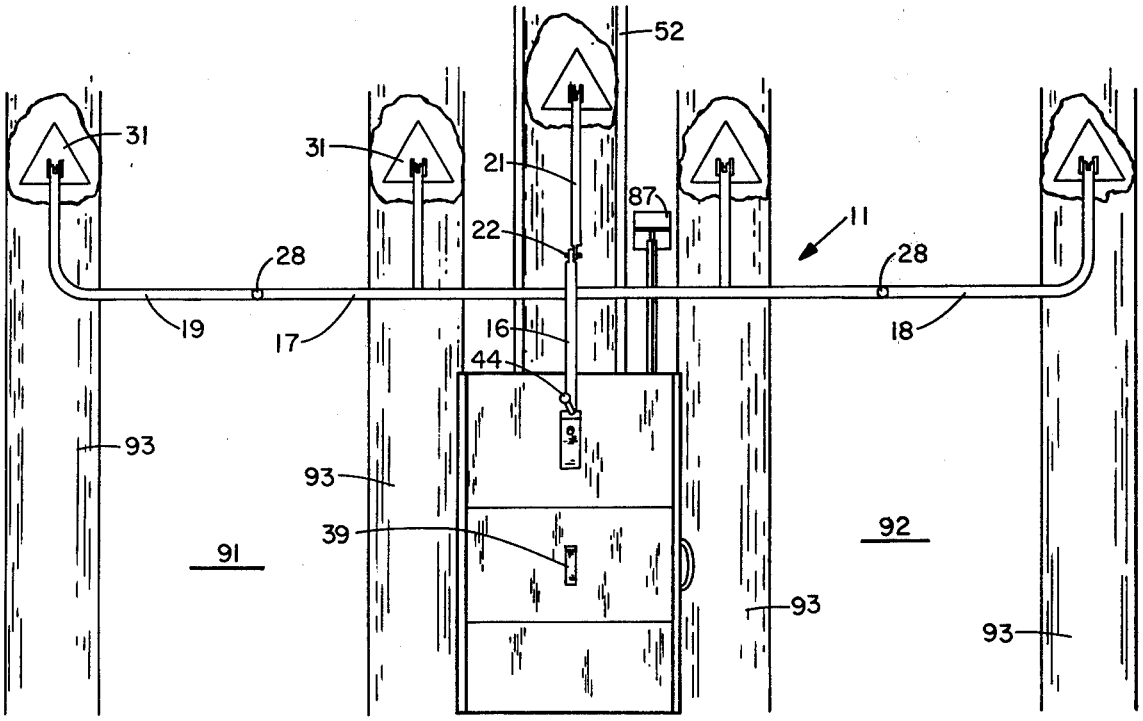
FIG. 2 is a top plan view of the apparatus in operation atop a ball return chute.

The dusting appendage (FIGS. 1 and 2) is centrally oriented about and connected to the housing unit by a main strut 16. Attached to the main strut perpendicularly disposed thereto is a cross bar 17. Two extension arms 18 and 19 are attached to the cross bar 17 on either side of the main strut 16 and substantially equidistant therefrom. These two extension arms are further oriented directly away from the housing unit. A third extension arm 21 is pivotably attached by a pin 22 or the like to the forward end of the main strut 16, such that the third extension arm may move in a vertical plane substantially containing the line defined by the main strut.

Both ends of the cross bar 17 (FIGS. 1 and 2) are open and thereby expose a cylindrical orifice 23. Two L-shaped extension arms 24 and 26 are provided to fit nonpermanently into such orifices, one for each side. Each L-shaped extension arm 24 and 26 is provided with a male lead 27 of a diameter less than the inner diameter of the cross arm orifice 23, such that the L-shaped extension arm and the cross arm fit snugly together. The two sections are further secured by the use of a nut and bolt 28, which bolt is inserted into a hole 29 radially disposed through both the cross bar and the L-shaped extension arm, and secured by a nut on the opposite side of the cross bar.

A pivotable mop head 31 (FIGS. 1 and 2) is attached to the free end of each of the five extension arms. The mop heads may be of any suitable variety available in the market, such as the one represented that is marketed under the trademark "Light & Easy."

The housing unit (FIGS. 1 and 5) in this embodiment is made of wood and is an irregularly shaped box-like structure. The unit is comprised of two side walls 32 and 33, a front boom support plate 34, a top plate 36 and a back plate 37 (visible in FIG. 5).

Figure 3:
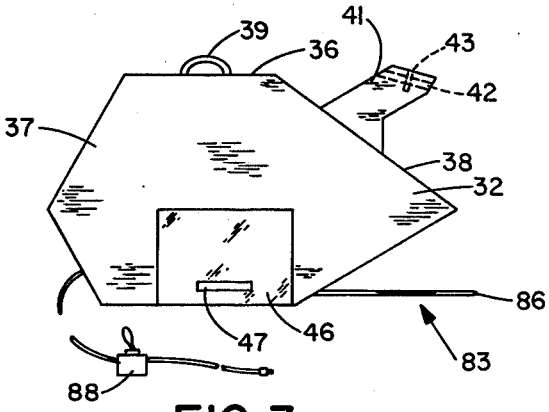
FIG. 3 is a side elevational view of the apparatus with the dusting appendage removed.
Figure 4:
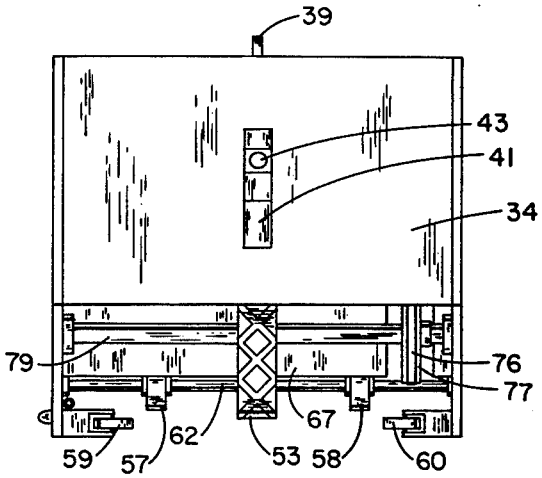
FIG. 4 is a front elevational view of the apparatus with the dusting appendage removed.

The forward portion of the side walls (FIG. 3) forms an acute projection, thereby defining an upwardly exposed sloping face 38 and a downwardly exposed sloping face 39. The rearward portion of the sidewalls may be similarly described, while noting that the projection is not as acute as is the projection of the forward portion.

The front boom support plate (FIGS. 1 and 3) is affixed between the two side walls, and is cut to fit within the ambit of the upwardly exposed sloping face 38, thereby leaving the downwardly exposed sloping face open and unenclosed. Similarly, the back plate is cut to fit the upwardly exposed sloping face defined by the rearward side wall projection, and the downwardly exposed sloping face is left unenclosed.

The top plate (FIG. 1) is horizontally disposed between the two side walls, the back plate, and the front boom support plate. Attached to the top plate is a handle 39 for greater ease in moving the housing unit about by hand.

The front boom support plate 34 (FIGS. 1 and 3) has a dusting appendage support boom 41 attached thereto. The boom is substantially a block projecting outwardly from the front boom support plate with two holes 42 and 43 drilled therein. The first is a main strut hole 42 which is formed completely through the support boom at an angle generally parallel to the plane defined by the front boom support plate 34. The second is a lock hole 43 which is disposed partway into the support boom such that it radially intersects with the main strut hole 42. When the main strut 16 of the dusting appendage 11 is inserted through the main strut hole 42, the main strut may then be locked in place by inserting a peg 44 through the lock hole and into a hole (not shown) radially disposed through the main strut for this purpose.

A service door 46 (FIG. 3) may also be included, as indicated on this preferred embodiment. The service door 46, located in side wall 32 of the housing unit, is hingeably attached thereto, and will open in an upward arc. A handle 47 is also attached to the service door to facilitate the opening of the door. A spring 48 (FIG. 6) is provided within the housing unit to insure that the service door 46 will normally remain tightly closed and serves another useful purpose with respect to the guidance system that will be explained more fully below. The spring 48 is secured on one end to a hook 49, which is fastened to the inner wall of the opposite side wall 33, and on the other end to a second hook 51 which is fastened to the innerwall of the door.

The apparatus 10 (FIGS. 5 and 6) is designed to operate in motion upon the ball return chute 52 of a bowling alley (which operation will be disclosed in detail below), and consequentially the guidance structure 13 is necessary. The guidance structure used herein will now be disclosed as follows.

Guidance is performed by a number of wheels operating in concert with one another. These are the main drive wheel 53 (FIGS. 5 and 6) (described in greater detail below), two vertical support wheels 56 and 57, and four horizontally disposed guide wheels 58 though 61. The two vertical support wheels 56 and 57 are rotatably affixed to an axle 62, which axle is disposed crosswise between the side walls near the back of the housing unit. The axle is supported at either side wall by a support block 63 and 64 affixed to such side wall. The four horizontally disposed guide wheels are best described by referring to FIG. 6. There are two guide wheels attached to the inside face of each side wall near the bottom of that wall. In this embodiment, two of the guide wheels 58 and 59 are attached to the service door. This insures a snug fit of the guide wheels about the ball return chute 52, since the spring 51 that bias the service door tightly closed will also act to keep the two guide wheels 58 and 59 tightly against the ball return chute.

Figure 6:
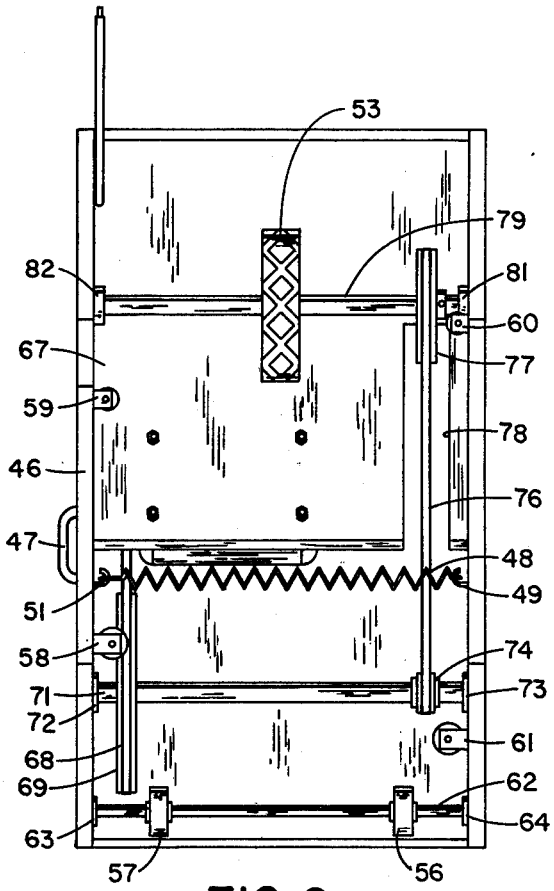
FIG. 6 is a bottom plan view of the apparatus with the dusting appendage removed.
Figure 5:
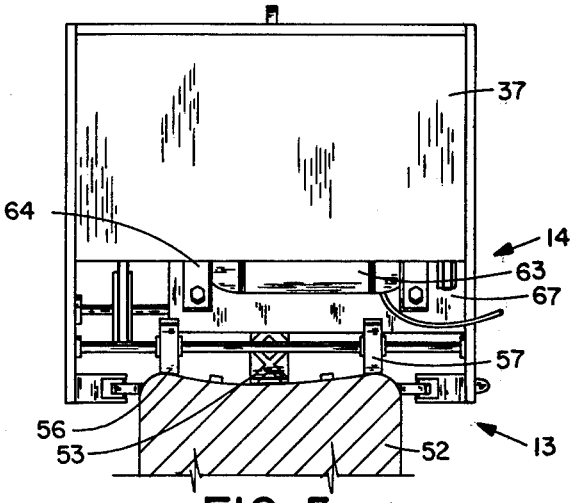
FIG. 5 is a rear elevational view of the apparatus atop a ball return chute with the dusting appendage removed.

The propulsion mechanism 14 is disclosed in FIG. 5, and includes an electric motor 63 which provides the mechanical power for the apparatus. The electric motor is connected to two L-shaped metal brackets 64 and 66, which metal brackets are bolted to a sloping support shelf 67 (FIG. 6). The drive axle (not shown) of the electric motor is connected to a first belt 68, which first belt is attached to a large diameter pulley 69. This large pulley is affixed to a first drive axle 71, which first drive axle 71 is rotatably connected to both side walls by support blocks 72 and 73 affixed thereon. A small pulley 74 is affixed at the opposite end of the first drive axle 71. This small pulley is operably connected via a second belt 76 with a drive pulley 77. It will be noted that the sloping support shelf has a notch 78 cut therein to allow the proper operation of the second belt. The drive pulley 77 is affixed to a second drive axle 79, which axle is rotatably connected to both side walls by support blocks 81 and 82 affixed thereon. Centrally located along the second drive axle and affixed thereto is the main drive wheel 53.

When the electric motor 63 is energized, the first belt will turn the large pulley 69, thereby turning the small pulley 74 via the first drive axle 71. The small pulley will turn the second belt and thereby cause the main drive wheel to rotate. Since the main drive wheel is in contact with a surface plane, the ball return chute 52, the turning of the main drive wheel will cause the apparatus 10 to move.

Figure 7:
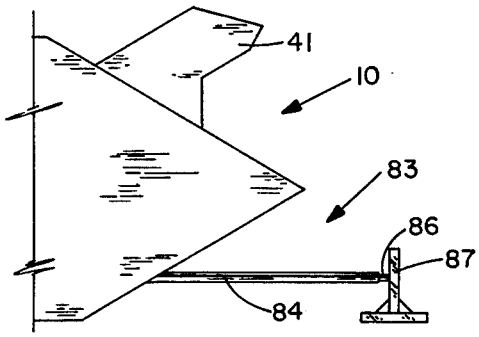
FIG. 7 is an enlarged cutaway side elevational view of the front of the apparatus.

In the preferred embodiment, control over the propulsion mechanism is maintained by a remote control device 83 (FIGS. 3 and 7) wired directly to the electric motor.

The remote control device 83 includes an elongated switch unit 84 having a spring biased push-pull lever 86 projecting forwardly of the apparatus 10. The lever is operably connected to the switch unit which in turn is electrically connected to the circuitry of the electric motor 63. Operation of the lever causes the motor to reverse its direction of rotation thereby causing the apparatus to reverse its direction of movement. Actuation of the lever is accomplished by engaging a stop 87 disposed in the path of the apparatus 10. A manual switch 88 is also connected to the circuitry wherein the direction of movement is controlled manually.

The operation of the device may now be disclosed as follows. As viewed in FIG. 2, bowling alleys are generally designed with a number of lanes 91 and 92 arranged parallel to each other. On each side of each lane there is a gutter 93 wherein the ball may be kept within the periphery of that lane's boundaries and yet may serve to prevent a bowling ball from striking any pins if the bowling ball moves close enough to the gutter to fall therein. Generally, a bowling gutter may be described as a longitudinal valley or as the longitudinal half-section of a hollow cylinder. Between every other bowling lane there is also the ball return chute 52; that is, a path whereby a bowling ball delivered down the lane to the pins may be returned to the person bowling. Generally, this ball return chute is a structure raised in height above the gutters. It is in conjunction with this ball return chute that the instant apparatus is designed to operate.

Referring to FIG. 5, the apparatus may be seen positioned upon a silhouetted cross section of a ball return chute 52. Since the downwardly exposed sloping faces of both the front and back of the housing unit are open, the housing unit will envelope somewhat the top of the ball return chute. The main drive wheel 53 rests in the center of the ball return chute, and the two vertical support wheels 56 and 57 support the rearward section of the housing unit. The four guide wheels 58 through 61 fit on either side of the ball return chute and serve to prevent the apparatus from veering off the ball return chute when the apparatus is in motion.

Referring back to FIG. 2, the dusting appendage 11 is attached to the housing unit 12 in the manner described earlier, and a mophead 31 is placed in each of four gutters 93 and in the ball return chute 53. Since ball return chutes often have both downward and upward slopes in them, the mop arm for the ball return chute is designed to accomodate for that by the inclusion of a pivotable extension arm 21, as disclosed earlier.

When the electric motor is activated, the apparatus will proceed down the ball return chute, dusting both the ball return chute and the gutters for both lanes adjacent. When the apparatus reaches the end of the chute, the lever engaging the stop reverses the direction of the apparatus, and it returns to the starting point. The apparatus is then moved to the next ball return chute, and the procedure is repeated.

It should be clear that many variations of the instant invention will occur to those skilled in the art, which variations do not fall without the inventive ambit herein claimed. Such variations are intended to be included within the scope of the claims annexed hereto.

I claim:

1. A bowling alley gutter duster apparatus which is operable to move up and down the ball return chute disposed between adjacent alleys wherein the chute has a generally horizontal top disposed between generally vertical side walls, the apparatus comprising:

housing means;

guidance means affixed to said housing means and operable to engage the top and sides of the chute and to support the housing on the chute;

propulsion means affixed to said housing means and operable in combination with said guidance means to propel said housing means along the chute; and dusting means affixed to said housing means and coactable with at least one of the bowling alley gutters.

2. A bowling alley gutter duster apparatus as defined in claim 1 and said dusting means includes a main strut affixed to and projecting forwardly of said housing means; a cross bar affixed to said main strut and extending laterally of said housing means; a plurality of spaced arms affixed to said strut, each having an end projecting from said strut; and a dusting element secured to each said arm end.

3. A bowling alley gutter duster apparatus as defined in claim 2 and at least one of said arms is pivotally secured to said strut.

4. A bowling alley gutter duster apparatus as defined in claim 1 and said guidance means includes a generally vertically disposed main drive wheel; at least one vertically disposed support wheel spaced from said drive wheel; and at least one pair of horizontally disposed, opposed guide wheels coactable with the chute side walls.

5. A bowling alley gutter duster apparatus as defined in claim 4 wherein at least one of said guide wheels is spring biased against the chute sidewall.

6. A bowling alley gutter duster apparatus as defined in claim 4 and said housing means includes a top wall and a pair of depending sidewalls with one of said sidewalls having an opening formed therein, a service door hingedly connected to said one sidewall over said opening, and a spring interconnecting said service door and said other sidewall to retain said service door in a normally closed position, said service door having one of said guide wheels affixed thereto.

7. A bowling alley gutter duster apparatus as defined in claim 4 and said propulsion means includes a motor mounted in said housing and having a rotating shaft operably connected to said drive wheel, an elongated switch unit secured on one end to said housing and having the other end projecting forwardly therefrom said switch unit operably connected to said motor, and a stop unit affixed to the chute in the path of said switch unit wherein engagement of said switch unit with said stop unit reverses the direction of rotation of said shaft.

8. A bowling alley gutter duster apparatus as defined in claim 7 and said housing means includes a top wall and a pair of depending sidewalls with one of said sidewalls having an opening formed therein, a service door hingedly connected to said one sidewall over said opening, and a spring interconnecting said service door and said other sidewall to retain said service door in a normally closed position, said service door having one of said guide wheels affixed thereto.

9. A bowling alley gutter duster apparatus as defined in claim 8 and said dusting means includes a main strut affixed to and projecting forwardly of said housing means; a cross bar affixed to said main strut and extending laterally of said housing means; a plurality of spaced arms affixed to said strut, each having an end projecting from said strut; and a dusting element secured to each said arm end.

10. A bowling alley gutter duster apparatus as defined in claim 9 and at least one of said arms is pivotally secured to said strut.

* * * * *